US008006921B2

(12) United States Patent
Yamasaki et al.

(10) Patent No.: US 8,006,921 B2
(45) Date of Patent: Aug. 30, 2011

(54) COATING MATERIAL CARTRIDGE

(75) Inventors: Isamu Yamasaki, Toyota (JP); Takanobu Mori, Toyota (JP); Noriyuki Achiwa, Toyota (JP)

(73) Assignees: Trinity Industrial Corporation, Aichi (JP); Toyota Jidosha Kabushiki Kaisha, Aichi (JP)

( * ) Notice: Subject to any disclaimer, the term of this patent is extended or adjusted under 35 U.S.C. 154(b) by 339 days.

(21) Appl. No.: 12/279,355

(22) PCT Filed: Jul. 12, 2007

(86) PCT No.: PCT/JP2007/064294

§ 371 (c)(1),
(2), (4) Date: Aug. 14, 2008

(87) PCT Pub. No.: WO2008/007812

PCT Pub. Date: Jan. 17, 2008

(65) Prior Publication Data

US 2009/0056621 A1 Mar. 5, 2009

(30) Foreign Application Priority Data

Jul. 14, 2006 (JP) ..... 2006-194565

(51) Int. Cl.
*A62C 31/00* (2006.01)

(52) U.S. Cl. ..... 239/305; 239/327; 239/328; 239/223; 239/569; 222/92; 222/325; 118/323; 141/20.5

(58) Field of Classification Search ..... 239/305, 239/322, 327, 328, 329, 569, 223; 222/92, 222/94, 206, 209, 213, 325, 394, 395; 118/300, 118/323; 114/20.5
See application file for complete search history.

(56) References Cited

U.S. PATENT DOCUMENTS

| | | | | |
|---|---|---|---|---|
| 6,164,561 | A * | 12/2000 | Yoshida et al. | 239/223 |
| 6,253,800 | B1 | 7/2001 | Yoshida et al. | |
| 6,742,722 | B2 * | 6/2004 | Hosoda et al. | 239/305 |
| 7,156,045 | B2 | 1/2007 | Ueno et al. | |
| 2005/0189435 | A1 * | 9/2005 | Kubota et al. | 239/223 |

(Continued)

FOREIGN PATENT DOCUMENTS

JP 8-229446 9/1996

(Continued)

OTHER PUBLICATIONS

English language Abstract of JP 2005-087810.
English language Abstract of JP 8-229446.

(Continued)

*Primary Examiner* — Dinh Q Nguyen
(74) *Attorney, Agent, or Firm* — Greenblum & Bernstein, P.L.C.

(57) ABSTRACT

For providing a coating material cartridge capable of reliably discharging air and coating material stagnated in a hydraulic fluid chamber, a coating material cartridge has a cartridge main body, a partition body, a coating material transfer path and a plurality of hydraulic fluid transfer paths. The cartridge main body is detachably attached to a coating material filling device. The partition body partitions the inner region of the cartridge main body into a coating material chamber and a hydraulic fluid chamber. The coating material transfer path communicates the coating material chamber and the outer region of the cartridge main body, and each of the hydraulic fluid transfer paths communicates the hydraulic fluid chamber and a outer region of the cartridge main body. Each of the hydraulic fluid transfer paths has a plurality of openings that opens in the hydraulic fluid chamber and the distance for each of the openings from the connection end face is different from each other.

10 Claims, 7 Drawing Sheets

FOREIGN PATENT DOCUMENTS

| | | |
|---|---|---|
| JP | 11-262696 | 9/1999 |
| JP | 2000-176328 | 6/2000 |
| JP | 2005-087810 | 4/2005 |
| WO | 2006/001123 | 1/2006 |

OTHER PUBLICATIONS

English language Abstract of JP 2000-176328.
English language Abstract of JP 11-262696.

* cited by examiner

COATING MATERIAL CARTRIDGE

TECHNICAL FIELD

The present invention concerns a coating material cartridge mounted detachably to a coating material filling system or a coating machine.

BACKGROUND ART

Heretofore, in a coating system for coating an article(s) to be coated (hereinafter referred to as a work(s)) such as an automobile bodies, since coating at high quality is required, electrostatic coating machine excellent in the deposition efficiency and the smoothness of coating layer has been used.

In the electrostatic coating machine, a rotary atomizing head for atomizing an aqueous coating material for electrostatic coating is provided, and by application of high voltage to the rotary atomizing head, coating material particles atomized in the rotary atomizing head are charged and electrostatic coating is conducted.

The electrostatic coating machine includes a coating machine in which a coating material cartridge is mounted to a coating machine main body and a predetermined amount of a liquid for pumping out a coating material (hereinafter referred to as a hydraulic fluid) is filled thereby pumping out the coating material in the coating material cartridge and supplying the same to the rotary atomizing head to conduct coating (refer, for example, to Patent Citation 1).

The coating material cartridge has a coating material chamber and a hydraulic fluid chamber partitioned from each other by way of a partition, in which a coating material in the coating material chamber is pumped out along with movement of a piston after filling the hydraulic fluid.

By the way, since an electric current could leak by way of a coating material flowing through a coating material supply system, an insulation countermeasure for preventing this is necessary. As the countermeasure, there has been proposed, for example, to use an insulating solution (organic solvent or the like) as the hydraulic fluid.

The hydraulic fluid is a fluid having a specific gravity as low as from 0.7 to 0.9, and with a reduced weight compared with an aqueous coating material for use in electrostatic coating having a specific gravity from 1.1 to 1.3.

Further, as another insulation countermeasure, it has been proposed to mount a coating material cartridge 100 having a coating material bag 101 filled with a coating material (refer to FIG. 7) to a coating machine main body instead of an existent coating material cartridge. By the use of the coating material cartridge 100, since coating material leakage from the inside of the coating material chamber 102 (inside of the coating material bag 101) to the hydraulic fluid chamber 103 is prevented completely, current leakage can be prevented more reliably. In this case, the coating material is supplied to a rotary atomizing head by filling the hydraulic fluid into the hydraulic fluid chamber 103 and pumping out the coating material in the coating material bag 101. The coating material cartridge 100 is mounted not only to the coating machine but also to a coating material filling device 110 (refer to FIG. 7). The coating material filling device 110 fills a coating material in the coating material chamber 102 when the coating material cartridge 100 is mounted.

Further, in the coating material cartridge described in the Patent Citation 1, since the coating material chamber occupies a lower region of a piston and the hydraulic fluid chamber occupies an upper region of the piston, an opening of a hydraulic fluid transfer path 104 for supplying and charging the hydraulic fluid to the hydraulic fluid chamber is disposed in an upper portion of the coating material cartridge 100. Further, also in a coating material cartridge 100 in which the piston is replaced with the coating material bag 101, the opening of the hydraulic fluid transfer path 104 is disposed in an upper portion of the coating material cartridge 100.

[Patent Citation 1] JP-A No. 2000-176328 (refer to FIG. 1, etc.)

DISCLOSURE OF INVENTION

Technical Problem

By the way, when air A1 is mixed to the hydraulic fluid, since a predetermined amount of the hydraulic fluid can not be filled in the hydraulic fluid chamber 103 upon mounting the coating material cartridge 100 to the coating machine, an important discharge amount of the coating material becomes instable. In the existent apparatus, since the opening of the hydraulic fluid transfer path 104 situates in an upper portion of the coating material cartridge 100, the air A1 can be released by way of the opening.

By the way, in a case where the coating material bag 101 is broken by some or other reasons, the coating material in the coating material bag 101 sometimes leaks all at once to the hydraulic fluid chamber. Even for the coating material cartridge described in the Patent Citation 1, in a case where a piston is tilted and a seal ring formed to the outer peripheral portion thereof is detached for instance, the coating material in the coating material chamber could leak all at once to the hydraulic fluid chamber. Then, in a case where the specific gravity of the hydraulic fluid is lower than that of the coating material, since the specific gravity of the coating material A2 mixed to the hydraulic fluid chamber 103 is higher than that of the hydraulic fluid, it precipitates at the bottom in the coating material cartridge 100. However, it is difficult to discharge the coating material leaked in the hydraulic fluid from the opening of the hydraulic fluid transfer path 104 in the upper portion of the coating material cartridge 100 to the outside of the coating material cartridge 100 in a state of mounting the coating material cartridge 100 to the coating material filling device 110.

The present invention has been achieved in view of the subject described above and the object thereof is to provide a coating material cartridge capable of reliably discharging air and the coating material stagnating in the hydraulic fluid chamber.

Technical Solution

For solving the foregoing subject, the invention described in claim 1 has a feature in a coating material cartridge, including a cartridge main body having a connection end face attached detachably to a coating material filling device or a coating machine, a partition body disposed deformably or displaceably in the cartridge main body for partitioning the inner region of the cartridge main body into a coating material chamber in which a coating material is filled and a hydraulic fluid chamber to and from which a hydraulic fluid is supplied and discharged for pumping out the coating material from the coating material chamber, a coating material transfer path capable of communication between the coating material chamber and the outer region of the cartridge main body, and a plurality of hydraulic fluid transfer paths capable of communication between the hydraulic fluid chamber and the outer region of the cartridge main body, in which the plurality of hydraulic fluid transfer path have a plurality of openings that open in the hydraulic fluid chamber and the distances from the plurality of openings to the connection end faces are different from each other.

Therefore, according to the invention described in claim 1, in a case where air mixed to the hydraulic fluid stagnates at a position remote from the connection end face in the cartridge main body, air can be discharged together upon discharging the hydraulic fluid from the opening at a position remote from the connection end face. This can stabilize the discharge amount of the coating material from the coating material chamber upon filling the hydraulic fluid. Further, in a case where the coating material mixed to the hydraulic fluid stagnates at a position near the connection end face in the cartridge main body, the coating material can be discharged together upon discharging the hydraulic fluid from the opening at the position near the connection end face.

The partition body disposed deformably in the cartridge main body includes, for example, diaphragms, and bellows. Further, the partition body disposed deformably in the cartridge main body includes, for example, a coating material bag in which the inside is formed as a bag-shape as the coating material chamber and which expands upon filling the coating material to the coating material chamber and shrinks upon filling the hydraulic fluid to the hydraulic fluid chamber (claim 3).

Further, the partition body disposed displaceably in the cartridge main body includes, for example, a piston. For reliably preventing the coating material leakage from the coating material chamber to the hydraulic fluid chamber, it is preferred to use a deformable partition body such as diaphragms, bellows or coating material bags.

Particularly, it is preferred to use a coating material bag showing a larger volumic change than the diaphragm and having a more simple structure than the bellows as the partition body.

In the invention described above, it is preferred that the coating material is an aqueous coating material for electrostatic coating, and the hydraulic fluid is an insulative transparent oily liquid having a difference in the specific gravity relative to the coating material. With such a constitution, leakage of the electric current by way of the coating material and the hydraulic fluid can be prevented. In this case, the hydraulic fluid includes thinner.

In the invention described in claim 2 according to claim 1, the cartridge main body includes a main body portion opened at one end and having a not connection end face at the outer surface on the other end and a base portion mounted with the main body portion so as to close the opening of the main body portion and having the connection end face on the side of the outer surface, and the plurality of hydraulic fluid transfer paths have an opening that opens near the not connection end face and an opening that opens at the bottom on the inner surface side of the base portion.

Therefore, according to the invention described in claim 2, since the opening that opens near the not connection end face is present, air stagnating near the not connection end face can be discharged reliably. Further, since the opening that opens at the bottom is present, the hydraulic fluid and the coating material stagnating at the bottom can be discharged reliably. Further, since the hydraulic fluid transfer path having the opening that opens at the bottom does not protrude into the cartridge main body, it is possible to prevent a portion of the hydraulic fluid transfer path from being in contact with the partition body to injure the same.

The invention described in claim 4 according to any one of claims 1 to 3 has a feature in that a hydraulic fluid transfer path on/off valve that turns the plurality of hydraulic fluid transfer paths into an open state when attached to the coating material filling device or the coating machine and turns the plurality of hydraulic fluid transfer paths into an closed state when not attached to the coating material filling device or the coating machine is disposed to the hydraulic fluid transfer path.

Therefore, according to the invention described in claim 4, since each of the plurality of the hydraulic fluid transfer paths is turned to the closed state upon detaching the coating material cartridge from the coating material filling device or the coating machine, leakage of the hydraulic fluid to the outer region of the cartridge main body can be prevented. Further, mixing of air to the hydraulic fluid can also be prevented.

ADVANTAGEOUS EFFECTS

As has been described above specifically, according to the inventions described in claims 1 to 4, air and coating material stagnating in the hydraulic fluid chamber can be discharged reliably.

EXPLANATION OF REFERENCE

Figure 1:
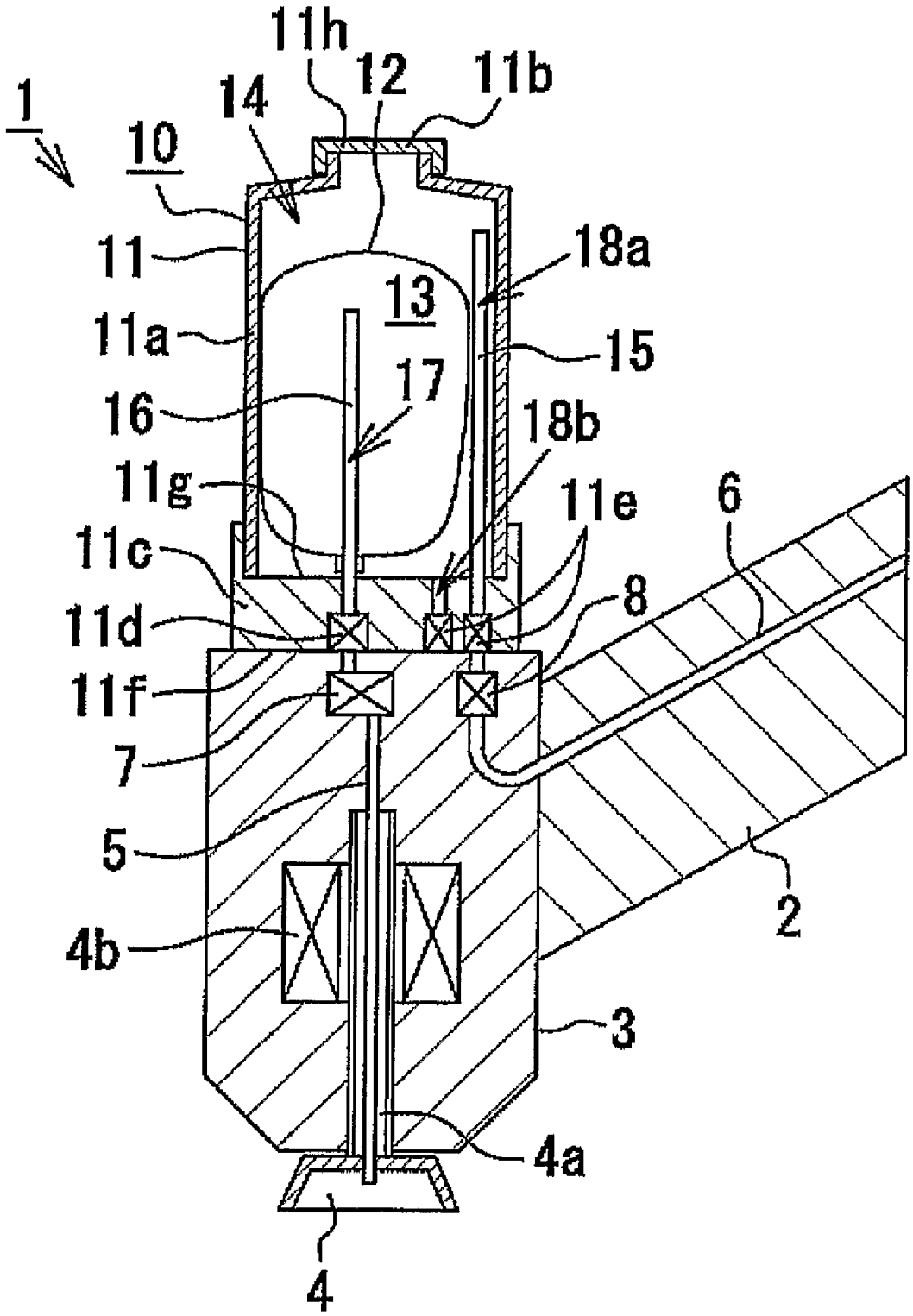
FIG. 1 is a schematic cross sectional view showing a coating machine in this embodiment.

1 coating machine
10 coating material cartridge
11 cartridge main body
11*a* main body portion
11*c* base portion
11*e* hydraulic fluid stop valve as a hydraulic fluid transfer path on-off valve
11*f* connection end face
11*g* bottom
11*h* not connection end face
12 coating material bag as a partition body
13 coating material
14 hydraulic fluid chamber
17 coating material transfer path
18*a*, 18*b* hydraulic fluid transfer path
21 coating material filling device

BEST MODE FOR CARRYING OUT THE INVENTION

A preferred embodiment embodying the present invention is to be described specifically with reference to the drawings.

At first, the constitution of a coating machines 1 is to be described. As shown in FIG. 1, the coating machine 1 is mounted to the top end of an arm 2 for a coating manipulator. At the front of a coating machine main body 3, a rotary atomizing head 4 is rotationally attached by way of a tubular rotary shaft 4*a* of an air motor 4*b* incorporated in the coating machine main body 3. The rotary atomizing head 4 is adapted to be applied with a high voltage from a not illustrated high voltage generator. That is, the coating machine is an electrostatic coating machine for conducting coating in a state of charging a coating material negatively and grounding a work such as an automobile body to the earth.

Further, a coating material cartridge 10 is attached detachably to a mounting portion disposed at the back of the coating machine main body 3. The cartridge main body 11 provided to the coating material cartridge 10 is made of a solvent resistant transparent resin and comprises a main body 11*a* and a base 11*c*. The main body portion 11*a* is opened at both ends and closed at one opening by a cover 11*b*. The outer surface of the cover 11*b* forms a not connection end face 11*h* not connected to a mounting portion of the coating machine main body 3. Further, the base 11*c* has a connection end face 11*f* that can be connected to the mounting portion of the coating machine main body 3 on the side of the outer surface, and has a bottom 11*g* on the side of the inner surface. The main body 11*a* is attached on the side of the bottom 11*g* of the base 11*c*, by which the other opening of the main body 11*a* is closed.

As shown in FIG. 1, a coating material bag 12 (partition body) is disposed in the cartridge main body 11. The coating material bag 12 is a flexible bag made of a resin and is made deformable. The coating material bag 12 partitions the inner region of the cartridge material main body 11 into a coating material chamber 13 in which the coating material is filled and a hydraulic fluid chamber 14 for supplying and discharging a hydraulic fluid for pumping out the coating material from the coating material chamber 13 and is adapted to prevent contact between the coating material and the hydraulic fluid. Further, since the coating material bag 12 is formed into a bag-shape having an opening at one end, the inside of the coating material bag 12 forms the coating material chamber 13. In this case, the coating material used in this embodiment is an electroconductive aqueous coating material for electrostatic coating, and the hydraulic fluid used in the embodiment is an insulative transparent oily liquid such as an organic solvent. Accordingly, the specific gravity of the transparent oily liquid is from 0.7 to 0.9, which is lower than the specific gravity (1.1 to 1.3) of the aqueous coating material for electrostatic coating.

The coating material bag 12 deforms and shrinks upon filling of the hydraulic fluid in the hydraulic fluid chamber 14. Correspondingly, the coating material in the coating material 12 (in the coating material chamber 13) is pumped out to the outer region of the coating material cartridge 11. Further, the coating material bag 12 deforms to expand upon filling of the coating material to the inside (in the coating material chamber 13). Correspondingly, the hydraulic fluid in the shrunk hydraulic fluid chamber 14 is pumped out to the outer region of the cartridge main body 11. In this embodiment, the maximum volume of the coating material chamber (coating material bag 12) 13 is set to about 500 cc and the maximum volume of the hydraulic fluid chamber 14 is set to about 1000 cc.

As shown in FIG. 1, a coating material cartridge 10 has a system of a coating material transfer path 17 capable of communication between the coating material chamber 13 and the outer region of the cartridge main body 11. The coating material transfer path 17 extends in parallel with the central axis of the main body portion 13*a* of the cartridge main body 11 and comprises a through hole that penetrates about a central portion of the base 11*c* and a coating transfer pipe 16 with the base end being inserted into the through hole. The coating material transfer pipe 16 protrudes from about the central portion of the base 11*g* of the base 11*c* into the coating material 13 (into the coating material bag 12). The coating material transfer path 17 has an opening that opens in the coating material chamber 13 (that is, the opening at the top end of the coating material transfer pipe 16). Further, a coating material stop valve 11*d* is disposed to the coating material transfer path 17. The coating material stop valve 11*d* is disposed in the base 11*c* and connected to the base end of the coating material transfer pipe 16.

As shown in FIG. 1, the coating material cartridge 10 has two systems of hydraulic fluid transfer paths 18*a*, 18*b* capable of communication between the hydraulic fluid chamber 14 and the outer region of the cartridge main body 11. Each of the hydraulic fluid transfer paths 18*a*, 18*b* extends parallel with the central axis of the main body portion 11*a*. One hydraulic fluid transfer path 18*a* is disposed near the inner wall surface of the main body 11*a* and the other hydraulic fluid transfer path 18*b* is disposed between the hydraulic fluid transfer path 18*a* and the coating material transfer path 17. The hydraulic fluid transfer channel 18*a* comprises a through hole that penetrates the outer periphery of the base 11*c* and a hydraulic fluid transfer pipe 15 with the base end being inserted in the through hole. The hydraulic fluid transfer pipe 15 protrude from the outer periphery of the bottom 11*g* to the hydraulic fluid chamber 14. On the other hand, since the other hydraulic fluid transfer path 18*b* only consists of the through hole that penetrates the base 11*c*, the hydraulic fluid transfer pipe 15 or the like does not protrude from the bottom 11*g* to the hydraulic fluid chamber 14.

As shown in FIG. 1, each of the other hydraulic fluid transfer paths 18*a*, 18*b* has an opening that opens in the hydraulic fluid chamber 14. Distances from the respective openings to the connection end face 11*f* are different from each other. Specifically, the opening at a position remote from the connection end face 11*f* (that is, the opening at the top end of the hydraulic fluid transfer pipe 15 constituting the other hydraulic fluid transfer path 18*a*) situates near the cover 11*b* (near the not connection end face 11*h*). Further, since the opening at the top end of the hydraulic fluid transfer pipe 15 opens in the upper portion of the coating material bag 12, this can prevent the hydraulic fluid transfer pipe 15 from being caught by the coating material bag 12. On the other hand, the opening at a position near the connection end face 11*f* (that is, the opening of the other hydraulic fluid transfer path 18*b*) situates at the bottom 11*g* of the cartridge main body 11.

As shown in FIG. 1, each of the other hydraulic fluid transfer paths 18*a*, 18*b* is provided with a hydraulic fluid stop valve 11*e* as the hydraulic fluid transfer path on-off valve. Each of the hydraulic fluid stop valve 11*e* is disposed on the base 11*c* and the hydraulic fluid stop valve 11*e* disposed to the other hydraulic fluid transfer path 18*a* is connected with the base end of the hydraulic fluid transfer pipe 15. Each of the hydraulic fluid stop valves 11*e* turns each of the hydraulic fluid transfer paths 18*a*, 18*b* into an open state when attached to the coating machine 1, to communicate the hydraulic fluid chamber 14 and the outer region of the cartridge main body 11. Further, each of the hydraulic fluid stop valves 11*e* puts each of the hydraulic fluid transfer paths 18*a*, 18*b* to a closed state when not attached to the coating machine 1 to shut communication between the hydraulic fluid chamber 14 and the outer region of the cartridge main body 11.

As shown in FIG. 1, the coating material transfer pipe 16 is in communication with a coating material discharge channel 5 in the coating machine main body 3 by way of the coating material stop valve 11*d*. The coating material discharge channel 5 is inserted through the tubular rotary shaft 4*a* and this is a channel for supplying the coating material pumped out from the coating material chamber 13 to the rotary atomizing head 4. Further, a trigger valve 7 is disposed on the coating material discharge channel 5 for switching the coating material stop valve 11*d* into an open state to communicate the coating material discharge channel 5 and switching the coating material stop valve 11*d* into a closed state to shut the coating material discharge channel.

On the other hand, the hydraulic fluid transfer pipe 15 is in communication with the hydraulic fluid channel 6 in the coating machine main body 3 by way of the hydraulic fluid stop valve 11*e*. The hydraulic fluid channel 6 is a channel for supplying a hydraulic fluid by way of a pipeline extending along the arm 2 of a coating manipulator in the hydraulic fluid chamber 14 of the coating material cartridge 10. Further, a trigger valve 8 is disposed on the hydraulic fluid channel 6 for communication and shutting of the hydraulic fluid channel 6.

The trigger valves 7, 8 in this embodiment are solenoid valves actuated by not-illustrated solenoids.

Figure 2:
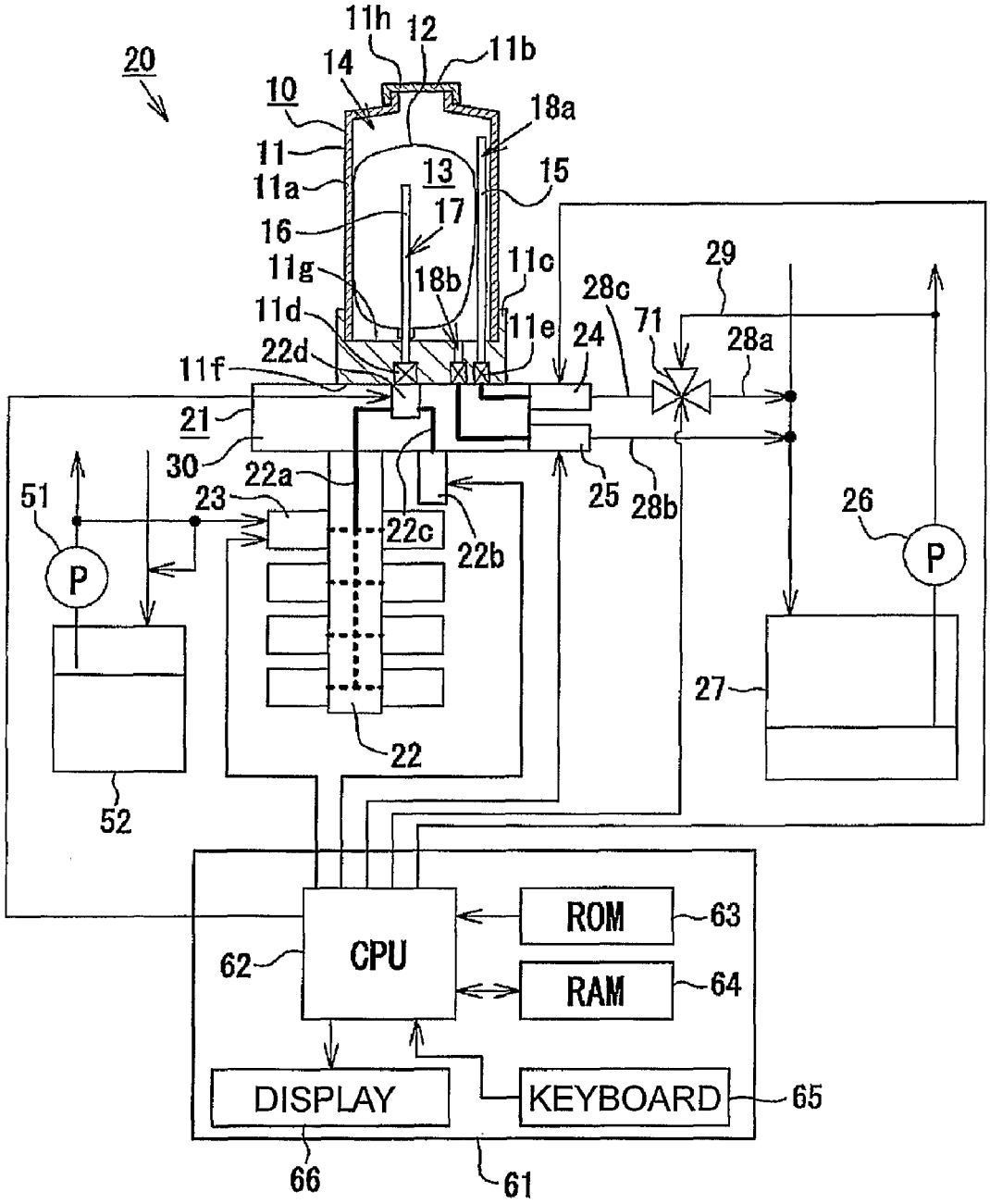
FIG. 2 is a constitutional view showing a coating material filling system in this embodiment.

A coating material cartridge 10 is adapted to be filled with a coating material in a state attached to a coating material filling system 20 shown in FIG. 2. The coating material filling system 20 has a coating material filling device 21, a hydraulic fluid storing vessel 27, a hydraulic fluid delivery pipeline 29, a first hydraulic fluid return pipeline 28*a*, a second hydraulic fluid return pipeline 28*b*, and a switching valve 71, etc. The coating material filling device 21 is connected by way of the switching valve 71 and the hydraulic fluid delivery pipeline 29 to the hydraulic fluid storing vessel 27. Further, the coating material filling device 21 is connected by way of the switching valve 71 and the first hydraulic fluid return pipeline 28*b* to the hydraulic fluid storing vessel 27. Further, the coating material filling device 21 is connected by way of the second hydraulic fluid return pipeline 28*b* to the hydraulic fluid storing vessel 27. The hydraulic fluid storing vessel 27 is a vessel for storing the hydraulic fluid.

A cartridge attaching portion 30 is disposed to the coating material filling device 21, and the coating material cartridge 10 is attached detachably with the connection end face 11*f* being directed downward to the upper surface of the cartridge attaching portion 30. In this state, since the hydraulic fluid stop valve 11*e* is in an open state, the coating material filling device 21 can fill the coating material by way of the coating material transfer path 17 in the coating material chamber 13.

As shown in FIG. 2, a coating material manifold 22 having a plurality of color valves 23 is attached to the lower surface of the cartridge attaching portion 30. In the coating material manifold 22, a coating material filling path 22*a* is disposed for introducing a coating material stored in a coating material tank 52 by way of a coating material pump 51 into the coating material chamber 13 upon switching the color valve 23 to an open state. Further, at the lower surface of the cartridge attaching portion 30, a discharge valve 22*b* is attached for discharging a coating material or the like upon switching to the open state. Then, in the cartridge attaching portion 30, a coating material discharge path 22*c* is disposed for discharging the coating material in the coating material chamber 13 by way of a discharge valve 22*b* to the outside. Further, to a connection portion for the coating material stop valve 11*d*, the coating material filling path 22*a*, and the coating material discharge path 22*c*, a trigger valve 22*d* is disposed for shutting one of the coating material stop valve 11*d*, the coating material filling path 22*a*, and the coating material discharge path 22*c* and communicating remaining two of them. The color valve 23, the discharge valve 22*b*, and the trigger valve 22*d* in this embodiment are solenoid valves actuated by not-illustrated solenoids.

As shown in FIG. 2, on the hydraulic fluid transfer pipeline 28*c* for connecting a switching valve 71 and the hydraulic fluid transfer path 18*a*, a liquid supply and discharge valve 24 is disposed for switching the hydraulic fluid transfer pipeline 28*c* into an open state or a closed state. The liquid supply and discharge valve 24 is attached on the side of the cartridge attaching portion 30. The liquid supply and discharge valve 24 is adapted such that the hydraulic fluid can be filled into the hydraulic fluid chamber 14 by way of the hydraulic fluid transfer pipeline 28*c* and the hydraulic fluid transfer path 18*a* upon switching to the open state. Further, the liquid supply discharge valve 24 is adapted such that the hydraulic fluid in the hydraulic fluid chamber 14 can be discharged by way of the hydraulic fluid transfer pipeline 28*c*, and the other hydraulic fluid transfer path 18*a* to the hydraulic fluid chamber 14 upon switching to the closed state. Further, the liquid supply and discharge valve 24 is adapted such that the hydraulic fluid in the hydraulic fluid chamber 14 by way of the other hydraulic fluid transfer path 18*a* and the hydraulic fluid transfer pipeline 28*c*. Further, the switching valve 71 is disposed to a connection portion for the hydraulic fluid transfer pipeline 28*c*, the hydraulic fluid delivery pipeline 29 and the first hydraulic fluid return pipeline 28*a*. The switching valve 71 is adapted to shut one of the hydraulic fluid transfer pipeline 28*c*, the hydraulic fluid delivery pipeline 29, and the first hydraulic fluid return pipeline 28*a* and communicate remaining two of them. Further, liquid supply and discharge valve 24 and the switching valve 71 in this embodiment are solenoid valves actuated by not-illustrated solenoids.

As shown in FIG. 2, on the hydraulic fluid delivery pipeline 29, a hydraulic fluid supply pump 26 is disposed. The hydraulic fluid delivery pipeline 29 is a path for supplying the hydraulic fluid stored in the hydraulic fluid storing vessel 27 by way of the switching valve 71, etc. to the hydraulic fluid chamber 14 by driving of the hydraulic fluid supply pump 16. The hydraulic fluid supply pump 26 is adapted to supply the hydraulic fluid also to other coating material filling device 21 (hydraulic fluid chamber 14 in the coating material cartridge 11) and other coating machine 1.

Further, on the second hydraulic fluid return pipeline 28*b*, a liquid discharge valve 25 is disposed for switching the hydraulic fluid return pipeline 28*b* into an open state or a closed state. The liquid discharge valve 25 is attached on the side of the cartridge attaching portion 30. The liquid discharge valve 25 is adapted such that the hydraulic fluid in the hydraulic fluid chamber 14 can be discharged by way of the hydraulic fluid transfer path 18*b* upon switching to the open state. That is, the path in which the liquid discharge valve 25 is disposed is a path different from the path in which the liquid supply and discharge valve 24 is disposed. The liquid discharge valve 25 in this embodiment is a solenoid valve actuated by a not illustrated solenoid. The second hydraulic fluid return pipeline 28*b* is a path for returning the hydraulic fluid discharged from the hydraulic fluid chamber 14 by way of the coating material filling device 21 and the second hydraulic fluid return pipeline 28*b* to the hydraulic fluid storing vessel 27. Since the second hydraulic fluid return pipeline 28*b* is connected also to other coating material filling device 21 or other coating machine 1, the hydraulic fluid discharged from other coating material charging device 21 or other coating machine 1 is also returned to the hydraulic fluid storing vessel 27.

Then an electric constitution of the coating material filling system 20 is to be described.

As shown in FIG. 2, the coating material filling system 20 has a personal computer 61, and the personal computer 61 comprises a CPU 62, an ROM 63, an RAM 64, an input/output circuit, etc. Further, the CPU 62 is electrically connected with a keyboard 65, a display 66, etc. The CPU 62 is electrically connected with the color valve 23, the discharge valve 22*b*, the trigger valve 22*b*, the liquid supply and discharge valve 24, the liquid discharge valve 25, and the switching valve 71, and controls them by various driving signals.

Then, the method of discharging the hydraulic fluid by using the coating material filling system 20 of the embodiment described above is to be described.

When the coating material in the coating material bag 12 of the coating material cartridge 10 is exhausted, for example, after coating of the coating machine 1, the coating material cartridge 10 is detached from the coating machine 1 and attached to the cartridge attaching portion 30 of the coating material filling device 21, with the connection end face 11*f* being directed downward. In this state, when the CPU 62 outputs a driving signal to the color valve 23 and the trigger valve 22*d*, the color valve 23 is switched to the open state and the trigger valve 22*d* is driven to turn the coating material stop valve 11*d* to an open state, by which the coating material filling path 22*a* and the coating material transfer pipe 16 are in communication with each other.

Figure 3A:
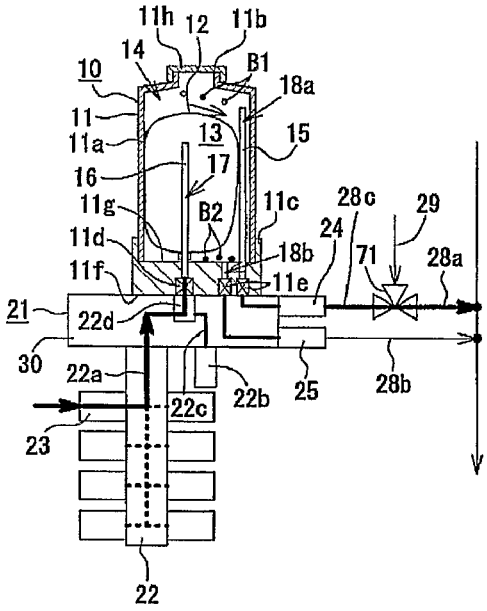
FIGS. 3(*a*) and (*b*) are explanatory views showing the method of discharging a hydraulic fluid.
Figure 3B:
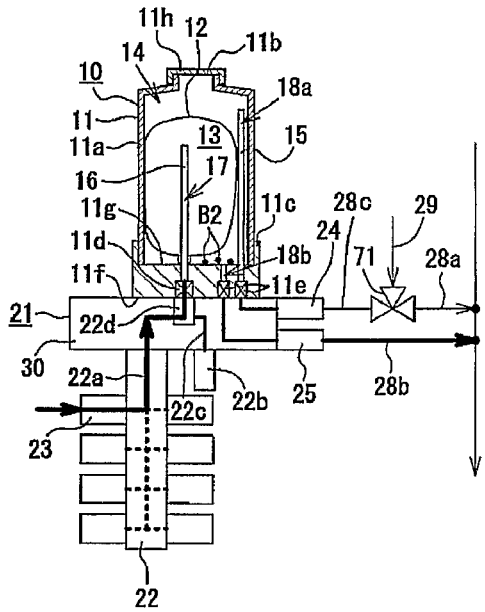

Thus, the coating material in the coating material tank 52 is passed through the coating material filling path 22*a*, the coating material stop valve 11*d*, and the coating material transfer pipe 16 by the coating material pump 51, and filled in the coating material bag 12 (refer to FIG. 3(*a*)).

Further, the CPU 62 outputs a driving signal to the color valve 23 and the trigger valve 22*b* and, at the same time, outputs a driving signal to the liquid supply and discharge valve 24 to switch the liquid supply and discharge valve 24 into an open state. Further, the CPU 62 outputs a driving signal to the switching valve 71 and drives the switching valves 71 to communicate the hydraulic fluid transfer pipeline 28*c* and the first hydraulic fluid return pipeline 28*a*. Accordingly, along with filling of the coating material in the coating material bag 12, the hydraulic fluid in the upper portion of the hydraulic fluid chamber 14 flows from the opening at a position remote from connection end face 11*f* (opening at the top end of the hydraulic fluid transfer pipe 15) into the hydraulic fluid transfer pipe 15. At the same time, also air B1 mixed to the hydraulic fluid flows into the hydraulic fluid transfer pipe 15 (refer to FIG. 13(*a*)). Thus, air B1 mixed to the hydraulic fluid in the cartridge main body 11 can be released. Then, the hydraulic fluid passes through the hydraulic fluid transfer path 18*a*, the liquid supply and discharge valve 24, the hydraulic fluid transfer pipeline 28*c*, the switching valve 71, and the first hydraulic fluid return pipeline 28*a* successively into a coating material excluding solution storing vessel 27.

After lapse of about one sec from the start of discharging the hydraulic fluid present in the upper portion of the hydraulic fluid chamber 14, the CPU 62 outputs a driving signal to the liquid discharge valve 25 to switch the liquid discharge valve 25 into an open state. Thus, the hydraulic fluid remaining in the hydraulic fluid chamber 14 flows into the hydraulic fluid transfer path 18*b* from the opening at a position near the connection end face 11*f*. Then, the hydraulic fluid passes the hydraulic fluid transfer path 18*b*, the liquid discharge valve 25, and the second hydraulic fluid return pipeline 28*b* successively into a hydraulic fluid storing tank 27.

By the way, when the coating material bag 12 is broken, the coating material in the coating material bag 12 leaks to the hydraulic fluid chamber 14 and mixed to the hydraulic fluid in the hydraulic fluid chamber 14. Then, since the coating material B2 mixed to the hydraulic fluid has a specific gravity higher than that of the hydraulic fluid, it is coagulated and stagnates on the bottom 11*g* in the cartridge main body 11 (refer to FIG. 3). Accordingly, the coating material B2 flows together with the hydraulic fluid into the hydraulic fluid transfer path 18*b* (refer to FIG. 3(*b*)). Thus, the coating material B2 can be discharged out of the cartridge main body 11.

When the filling of the coating material into the coating material bag 12 has been completed without occurrence of breakage of the coating material bag 12, the coating material cartridge 10 is detached from the cartridge attaching portion 30 of the coating material filling device 21 and attached to the coating machine 1. When the coating material cartridge 10 is attached to the coating machine 1, the hydraulic fluid is supplied by another driving source into the hydraulic fluid chamber 14 of the coating material cartridge 10. Correspondingly, since the coating material bag 12 deforms to shrink, the coating material in the coating material bag 12 is discharged by way of the trigger valve 7 and the tubular rotary shaft 4*a* from the rotary atomizing head 4 to conduct coating.

Accordingly, the following effects can be obtained by this embodiment.

(1) According to the coating material cartridge 10 of this embodiment, in a case where air mixed to the hydraulic fluid stagnates in the upper portion of the hydraulic fluid chamber 14, air can be discharged together when the hydraulic fluid is discharged from the opening of the hydraulic fluid transfer path 18*a*. Thus, the discharge amount of the coating material from the coating material chamber 13 during filling of the hydraulic fluid is stabilized. Further, in a case where the coating material mixed to the hydraulic fluid stagnates at the bottom of the hydraulic fluid chamber 14 (on the base 11*g* of the base 11*c*), the coating material can be discharged together upon discharging the hydraulic fluid from the opening of the hydraulic fluid transfer path 18*b*.

(2) In this embodiment, since the cartridge main body 11 has a plurality of hydraulic fluid transfer paths 18*a*, 18*b*, the hydraulic fluid can be drained from plural portions. Further, the opening of the hydraulic fluid transfer path 18*a* opens near the not connection end face 11*h* and the opening of the hydraulic fluid transfer path 18*b* opens at the bottom 11*b*. Accordingly, even in a case where the specific gravity of the coating material is lower than the specific gravity of the hydraulic fluid, air B1 and the coating material B2 can be discharged from the hydraulic fluid transfer path 18*a*. Further, in a case where the specific gravity of the coating material is identical with the specific gravity of the hydraulic fluid, air B1 and the coating material B2 can be discharged from both of the hydraulic fluid transfer path 18*a*, and the hydraulic fluid transfer path 18*b*. Therefore, various fluids can be used for the hydraulic fluid to enhance the general utilizability of the coating material cartridge 10. Further, air B1 and the coating material B2 can be discharged optionally by various methods (for example, discharge from the hydraulic fluid transfer path 18*b*). Further, the hydraulic fluid can be filled in the hydraulic fluid chamber 14 from either the hydraulic fluid transfer path 18*a* and the hydraulic fluid transfer path 18*b*.

(3) The hydraulic fluid transfer path 18*a* in this embodiment extends in parallel with the central axis of the main body portion 11*a* and is disposed near the inner wall surface of the main body portion 11*a*. Thus, the hydraulic fluid transfer path 18*a* does not hinder the expansion of the coating material bag 12 and, in addition, the volume of the coating material bag 12 can be ensured to an utmost degree.

(4) The hydraulic fluid transfer path 18*a* in this embodiment is not formed in the wall portion of the main body portion 11*a* but constituted with the hydraulic fluid transfer pipe 15 protruding into the hydraulic fluid chamber 14. Accordingly, the hydraulic fluid transfer path 18*a* can be manufactured easily.

(5) The hydraulic fluid transfer path 18*b* of this embodiment is consisted only of the through hole that penetrates the base 11*c* and does not protrude into the hydraulic fluid chamber 14. Accordingly, since it is no more necessary to take the positional relation with the coating material bag 12 into consideration upon providing the hydraulic fluid transfer path 18*b*, so that the hydraulic fluid transfer path 18*b* can be disposed at an optional position of the base 11*c*.

The embodiment of the present invention may be modified as described below.

In the coating material filling system 20 of the embodiment described above, the liquid supply and discharge valve 24 is disposed on the hydraulic fluid transfer pipeline 28*c* that connects the switching valve 71 and the hydraulic fluid transfer path 18*a*, and the liquid discharge valve 25 is disposed on the second hydraulic fluid return pipeline 28*b*. That is, the path in which the liquid discharge valve 25 is disposed and the path in which the liquid supply and discharge valve 24 is disposed are formed as separate paths.

Figure 4:
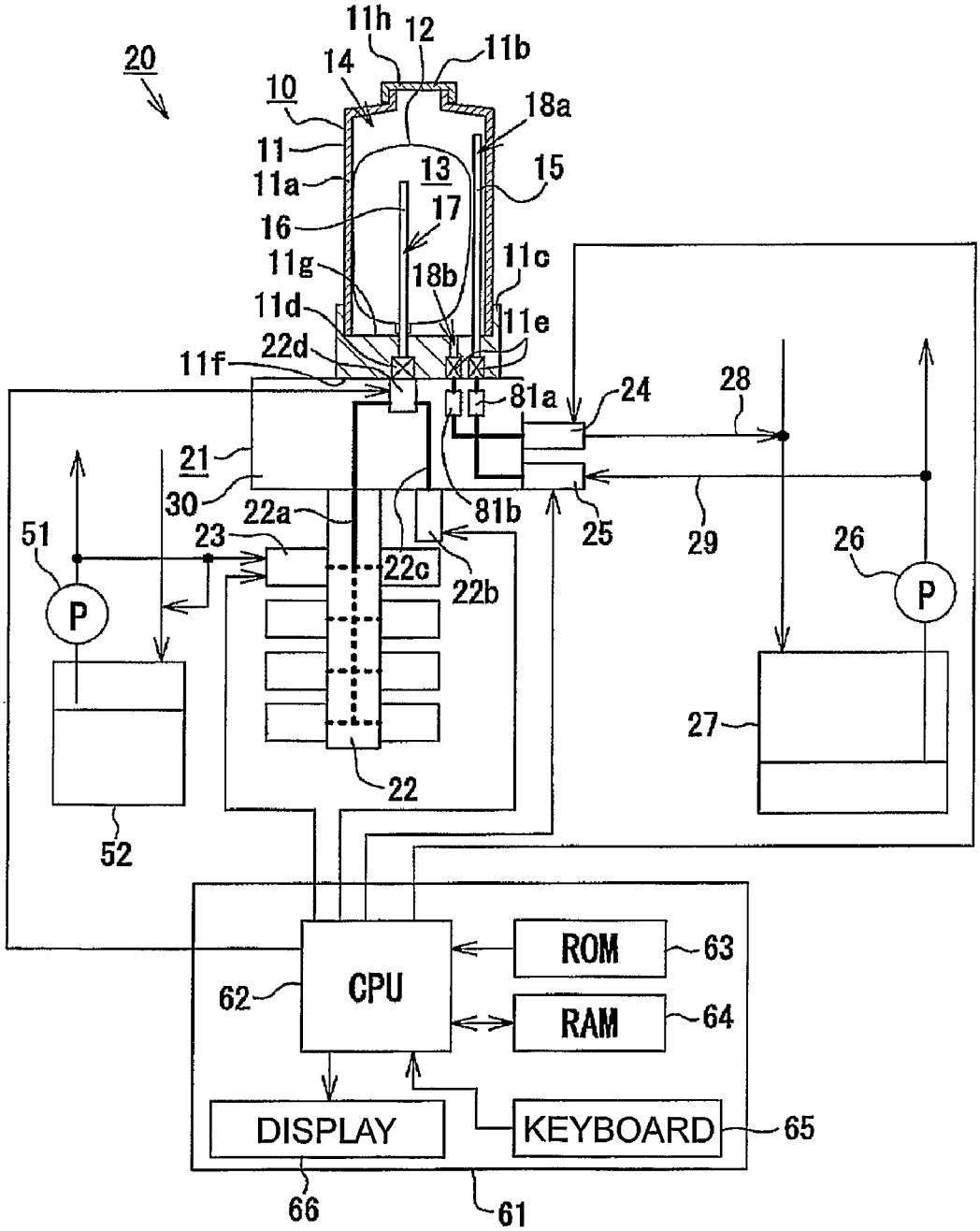
FIG. 4 is a constitutional view showing a coating material filling system in another embodiment.
Figure 5A:
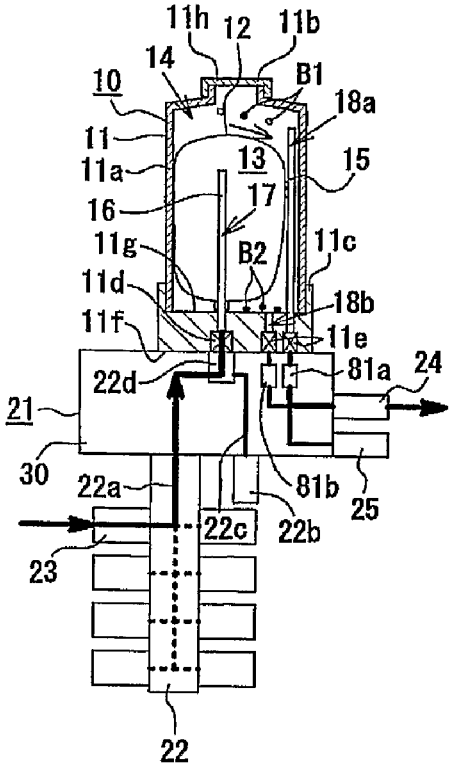
FIGS. 5(*a*) and (*b*) are explanatory views showing a method of discharging a hydraulic fluid in an another embodiment.
Figure 5B:
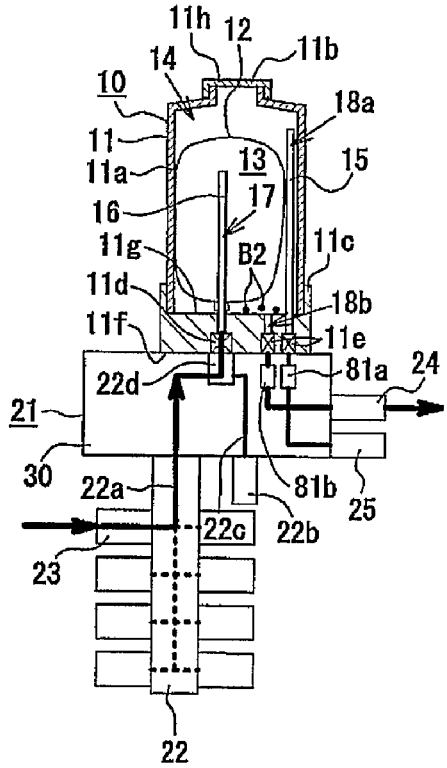
Figure 6A:
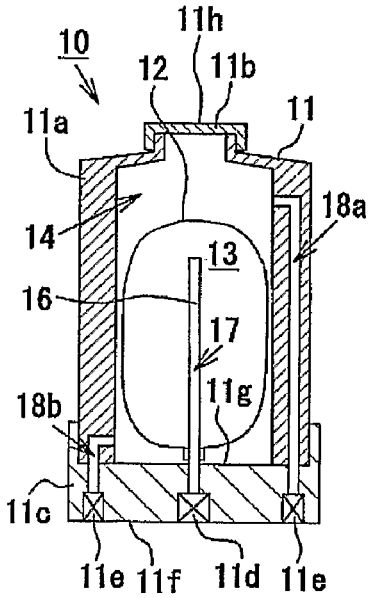
FIGS. 6(*a*) to (*d*) are schematic cross sectional views showing coating material cartridges in other embodiments.
Figure 6B:
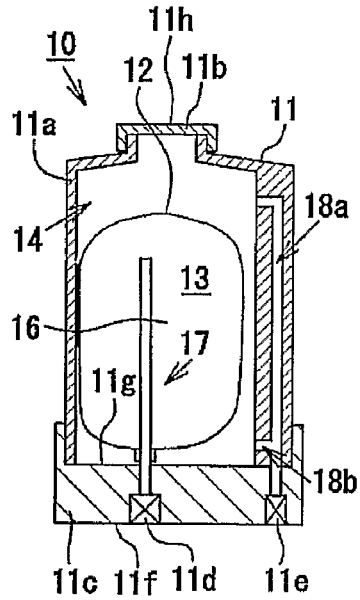
Figure 6C:
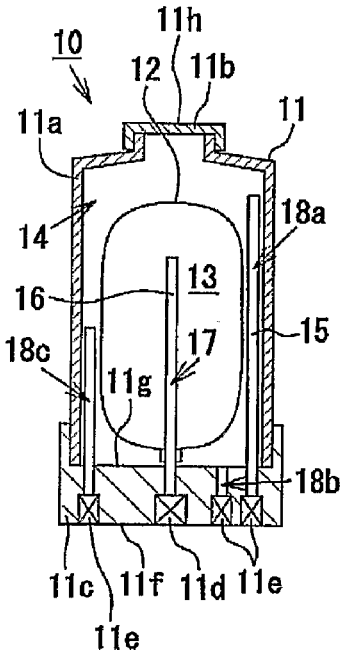
Figure 6D:
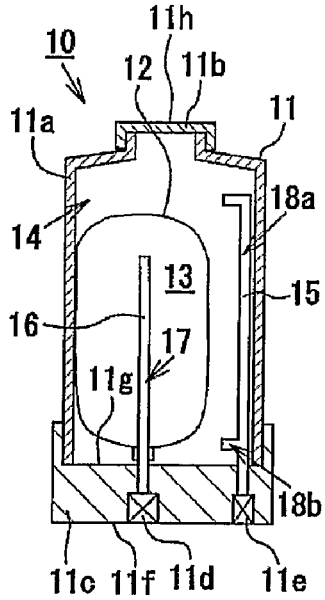
Figure 7:
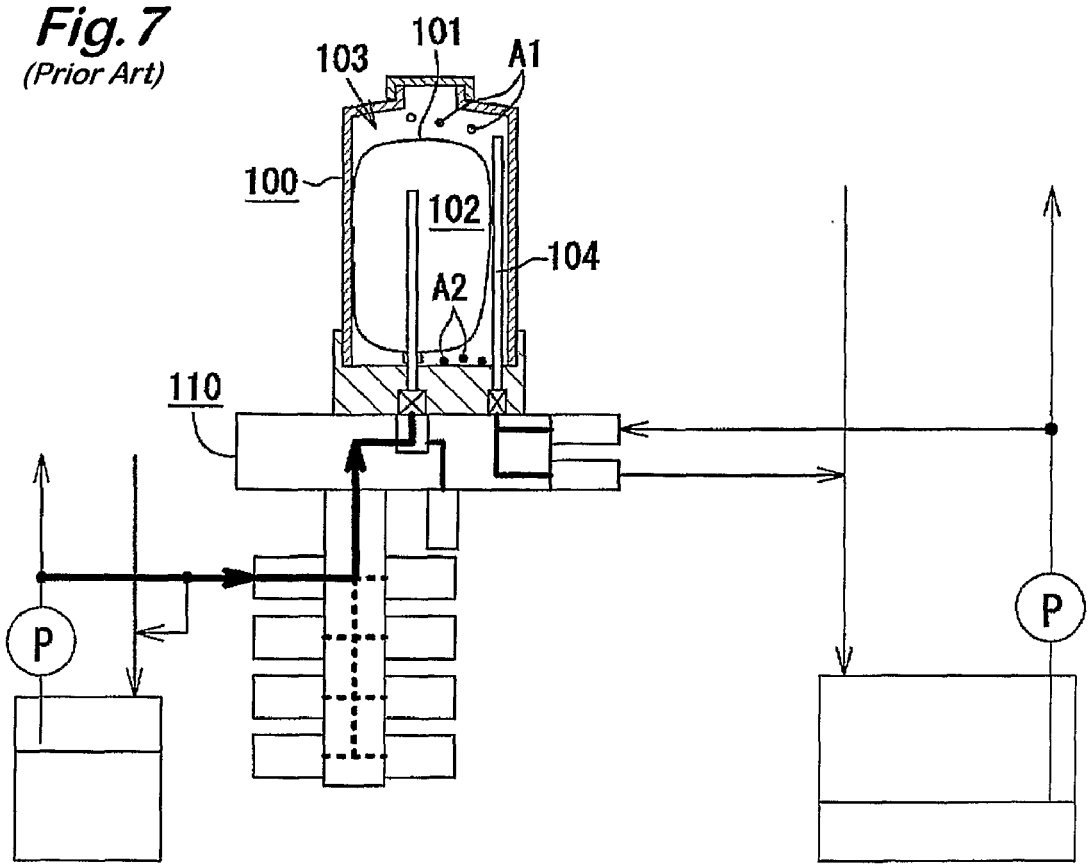
Fig. 7 (Prior Art)
FIG. 7 is a constitutional view showing a coating material filling system in the prior art.

However, the path to which the liquid discharge valve 25 is disposed and the path to which the liquid supply and discharge valve 24 is disposed may be in a common path. For example, as shown in FIG. 4, a first gate valve 81*a* for switching the hydraulic fluid transfer path 18*a* into the open state or closed state, and a second valve 81*b* for switching the hydraulic fluid transfer path 18*b* into an open state or a closed state are disposed in the cartridge attaching portion 30. Then, the first gate valve 81*a* is switched into an open state in a state of switching the liquid supply and discharge valve 24 into an open state, and the hydraulic fluid is discharged together with air B1 from the hydraulic fluid transfer path 18*a* (refer to FIG. 5(*a*)). Then, the second gate valve 81*b* is switched to an open state, and the hydraulic fluid is discharged from the hydraulic fluid transfer path 18*b* together with the coating material B2 in which the hydraulic fluid is precipitated (refer to FIG. 5(*b*)).

With such a constitution, the switching valve 71 disposed to the coating material filling system 20 of the embodiment can be saved and, in addition, the first hydraulic fluid return pipeline 28*a*, the second hydraulic fluid return pipeline 28*b*, and the hydraulic fluid transfer pipeline 28*c* can be collected in one hydraulic fluid return pipeline 28.

In the coating material cartridge 10 of the embodiment described above, the hydraulic fluid transfer path 18*a*, the hydraulic fluid transfer path 18*b* may be formed in the wall portion of the cartridge main body 11 (refer to FIG. 6(*a*), (*b*)).

In the embodiment described above, while the two systems of the hydraulic fluid transfer paths 18*a*, 18*b* are disposed to the cartridge main body 11, three or more systems of hydraulic fluid transfer paths may also be provided. For example, as shown in FIG. 6(*c*), a further hydraulic fluid transfer path 18*c* may also be disposed in addition to the hydraulic fluid transfer paths 18*a*, 18*b* to the cartridge main body 11.

While the hydraulic fluid transfer path 18*a*, and the hydraulic fluid transfer path 18*b* in the embodiment described above are paths in separate systems respectively, they may also be paths formed by blanching from one system of hydraulic fluid transfer path as shown in FIGS. 6(*b*), (*c*).

Then, in addition to the technical idea described in the scope of the claim for patent, those technical ideas contained by the embodiments described above are to be set forth below.

(1) A coating material cartridge according to claim 2, wherein the plurality of the hydraulic fluid transfer paths extend in parallel with the central axis of the main body portion and at least one of the plurality of hydraulic fluid transfer paths is disposed near the inner wall surface of the main body portion.

(2) A coating material cartridge according to claim 2 characterized in that the hydraulic fluid transfer path disposed near the inner wall surface of the main body portion comprises a hydraulic fluid transfer pipe protruding into the hydraulic fluid chamber.

A coating material cartridge according to any one of claims 1 to 4, characterized in that the coating material is an aqueous coating material for electrostatic coating, and the hydraulic fluid is an insulative transparent oily liquid having a difference in the specific gravity relative to the coating material.

(4) A coating material cartridge according to any one of claims 1 to 4, characterized in that the coating machine is an electrostatic coating machine conducting coating by negatively charging the coating material and grounding a work to the earth.

(5) A coating material cartridge according to claim 1 or 2, characterized in that the partition body is a piston displaceable in the cartridge main body in which upon filling the coating material in the coating material chamber, the volume of the hydraulic fluid chamber is decreased along with movement of the piston toward the hydraulic fluid chamber, to discharge the hydraulic fluid in the hydraulic fluid chamber to the outer region of the cartridge main body and, upon filling the hydraulic fluid to the hydraulic fluid chamber, the volume of the coating material chamber is decreased along with movement of the piston toward the coating material chamber to pump out the coating material in coating material chamber to the outer region of the cartridge main body.

(6) A coating material filling system characterized by providing a coating material filling device having a cartridge attaching portion to which the coating cartridge according to any one of claims 1 to 4 is attached detachably and a coating material filling path for introducing a coating material to the coating material chamber upon attaching the coating material cartridge, a hydraulic fluid storing vessel for storing the hydraulic fluid, and a hydraulic fluid return path for returning the hydraulic fluid discharged from the hydraulic fluid chamber by way of the coating material filling device to the hydraulic fluid storing vessel, providing a first connection channel in communication with the coating material filling path, a second connection channel for connecting a hydraulic fluid transfer path having an opening at a position remove from the connection end face and the hydraulic fluid return path, and a third connection path for connecting a hydraulic fluid transfer path having an opening at a position near the connection end face and the hydraulic fluid return path in the cartridge attaching portion, in which the second connection channel and the third connection channel are channels of systems different from each other.

INDUSTRIAL APPLICABILITY

This invention can be applied to the usage of discharging air and coating material stagnating in the hydraulic fluid chamber of the coating material cartridge.

What is claimed is:

1. A coating material cartridge comprising:

a cartridge main body having a connection end face and a non-connection end face, the connection end face disposed at one end of the cartridge main body and being configured for detachable attachment to one of a coating material filling device and a coating machine, and the non-connection end face being disposed at an outer surface of the cartridge main body opposite the connection end face;

a partition body deformably and displaceably disposed in the cartridge main body for partitioning an inner region of the cartridge main body into a coating material chamber in which a coating material is filled and a hydraulic fluid chamber to and from which a hydraulic fluid is supplied and discharged for pumping out the coating material from the coating material chamber;

a coating material transfer path capable of communication between the coating material chamber and an outer region of the cartridge main body; and a plurality of hydraulic fluid transfer paths capable of communication between the hydraulic fluid chamber and the outer region of the cartridge main body, wherein the plurality of hydraulic fluid transfer paths have at least one opening that opens near the connection end face of the cartridge main body and a second opening that opens near the non-connection end face, and wherein the hydraulic fluid chamber is provided within the cartridge main body.

2. The coating material cartridge according to claim 1, the cartridge main body further including:

a main body portion opened at one end, the non-connection end face being disposed at the other end; and a base portion mounted with the main body portion so as to close the opening of the main body portion, the connection end face being disposed at an outer surface of the base portion; wherein the first openings of the plurality of hydraulic fluid transfer paths are disposed toward a bottom on an inner surface side of the base portion.

3. The coating material cartridge according to claim 1, wherein the partition body is a material bag in which an inside thereof is formed into a bag-shape as the coating material chamber and which expands upon filling the coating material to the coating material chamber and shrinks upon filling the hydraulic fluid to the hydraulic fluid chamber.

4. The coating material cartridge according to claim 1, characterized in that a hydraulic fluid transfer path on/off valve, that turns the plurality of hydraulic fluid transfer paths into an open state when attached to one of the coating material filling device and the coating machine and that turns the plurality of hydraulic fluid transfer paths into a closed state when not attached to one of the coating material filling device and the coating machine, is disposed to the hydraulic fluid transfer path.

5. The coating material cartridge according to claim 2, wherein the partition body is a material bag in which an inside thereof is formed into a bag-shape as the coating material chamber and which expands upon filling the coating material to the coating material chamber and shrinks upon filling the hydraulic fluid to the hydraulic fluid chamber.

6. The coating material cartridge according to claim 2, characterized in that a hydraulic fluid transfer path on/off valve, that turns the plurality of hydraulic fluid transfer paths into an open state when attached to one of the coating material filling device and the coating machine and that turns the plurality of hydraulic fluid transfer paths into a closed state when not attached to one of the coating material filling device and the coating machine, is disposed to the hydraulic fluid transfer path.

7. The coating material cartridge according to claim 3, characterized in that a hydraulic fluid transfer path on/off valve, that turns the plurality of hydraulic fluid transfer paths into an open state when attached to one of the coating material filling device and the coating machine and that turns the plurality of hydraulic fluid transfer paths into a closed state when not attached to one of the coating material filling device and the coating machine, is disposed to the hydraulic fluid transfer path.

8. The coating material cartridge according to claim 5, characterized in that a hydraulic fluid transfer path on/off valve, that turns the plurality of hydraulic fluid transfer paths into an open state when attached to one of the coating material filling device and the coating machine and that turns the plurality of hydraulic fluid transfer paths into a closed state when not attached to one of the coating material filling device and the coating machine, is disposed to the hydraulic fluid transfer path.

9. The coating material cartridge according to claim 1, wherein the coating material transfer path extends from outside the cartridge main body into the partition body.

10. The coating material cartridge according to claim 1, wherein at least one of the plurality of hydraulic fluid transfer paths extend from outside the cartridge main body into the cartridge main body.

* * * * *